US005178461A

United States Patent [19]

Taniguchi

[11] Patent Number: 5,178,461

[45] Date of Patent: Jan. 12, 1993

[54] MIXING APPARATUS

[75] Inventor: Toru Taniguchi, Tokyo, Japan

[73] Assignee: Reica Corporation, Tokyo, Japan

[21] Appl. No.: 666,670

[22] Filed: Mar. 7, 1991

[30] Foreign Application Priority Data

Mar. 7, 1990 [JP] Japan ..... 2-55785
Jan. 17, 1991 [JP] Japan ..... 3-4004

[51] Int. Cl.[5] ..... B01F 11/00

[52] U.S. Cl. ..... 366/332; 366/307; 366/324

[58] Field of Search ..... 366/243, 255, 266, 276, 366/277, 278, 289, 302, 307, 256, 257, 258, 260, 307, 318, 320, 324, 332

[56] References Cited

U.S. PATENT DOCUMENTS

| | | | |
|---|---|---|---|
| 1,941,808 | 1/1934 | McConnaghay | 366/302 |
| 2,667,407 | 1/1954 | Fenske | 366/332 |
| 2,731,247 | 1/1956 | Hudry | 366/289 |
| 2,801,237 | 7/1957 | Clevy | 366/332 |
| 2,828,111 | 3/1958 | Messinger | 366/332 |
| 2,939,770 | 6/1960 | Schwartzkopff | 366/307 |
| 3,023,455 | 3/1962 | Geier | 366/289 |
| 3,219,320 | 11/1965 | Sutter | 366/289 |
| 3,301,138 | 1/1967 | Cox | 366/289 |
| 3,655,166 | 4/1972 | Sauer | 366/256 |
| 3,788,609 | 1/1974 | Toczyski | 366/289 |
| 4,522,499 | 6/1985 | Hadelmaier | 366/332 |
| 4,960,328 | 10/1990 | Schumacher | 366/307 |

FOREIGN PATENT DOCUMENTS

| | | | |
|---|---|---|---|
| 958698 | 12/1974 | Canada | 366/266 |

*Primary Examiner*—Harvey C. Hornsby
*Assistant Examiner*—Terrence R. Till
*Attorney, Agent, or Firm*—Fish & Richardson

[57] ABSTRACT

An agitator is disposed in the interior of a casing through which fluids to be mixed pass. The agitator is connected with a source of oscillation for oscillating the agitator in the axial direction. The inner wall of the casing includes a stationary vane extending inwardly therefrom. A relative motion is generated between the agitator and the stationary vane. When the fluids flow through the interior of the casing, they are agitated and mixed together by impingement of the fluids against the stationary vane and agitator and by the relative motion between the stationary vane and the agitator.

1 Claim, 9 Drawing Sheets

MIXING APPARATUS

BACKGROUND OF THE INVENTION

1. Field of the Invention:

The present invention relates to an apparatus for mixing fluids and particularly to a mixer for mixing fluids while permitting the fluids to pass therethrough.

2. Description of the Prior Art:

Various types of agitating and mixing devices have been utilized in chemical reactions such as pH adjustment, redox reaction and other reactions. With recent development of biotechnology, the agitation and mixture are becoming more important in the biological field as bacteria cultivation and so on.

One of such devices is a static mixer which is broadly utilized for mixing a liquid with another liquid or a gas. Such a static mixer comprises various types of agitators are disposed within pipes through which fluids to be mixed pass. These agitators create a turbulence promoting the mixing. Typically, the agitators are in the form of a cut screw arranged within a pipe.

There has also been proposed such a mixer that includes an agitator disposed within a pipe and connected to a shaft. This shaft is oscillated to promote the mixing.

One of the agitators mostly used in such a mixer comprises a spiral-shaped stirring vane which includes a plurality of openings formed therein with one opening in a spiral turn being out of phase relative to another opening in the adjacent spiral turn. It has been found that such an agitator is very effective in stirring and mixing.

It is believed that in such a stirring vane, the flows of fluid move into each of axial spacings or stages between each adjacent spiral turns through both a spiral channel defined by the spiral vane and a passage defined by the opening in the stirring vane and then impinge against each other in that spacing or stage to promote the mixing effect. At the same time, it is also anticipated that since the surface area of the spiral stirring vane is very large, the flow of fluid can be brought more effectively into contact with the surface of the spiral vane to promote the mixing operation by the oscillation of the agitator.

Although the aforementioned mixers can satisfactorily stir and mix fluids, it may be desirable that the agitation is increased depending on the type of fluid to be mixed. If the efficiency of mixture is further increased, the throughput in the mixer may be increased and the entire system may be reduced in size.

SUMMARY OF THE INVENTION

It is therefore an object of the present invention to provide a mixing apparatus which is further increased in efficiency.

To this end, the present invention provides a mixing apparatus comprising a casing through which the flow of fluid passes, a stationary vane located in and fixed to the casing, and a movable vane disposed within the casing and connected with a source of oscillation, the movable vane being oscillated by the source of oscillation while the flow of fluid moves through the casing, whereby a relative motion can be applied between the movable and stationary vanes to stir the fluid.

In such an arrangement, a fluid to be mixed, which is a mixture including two or more types of fluid components, is pumped through the casing. The pumped fluid mixture impinges on the vanes and is further stirred by the relative motion between the vanes.

As described, the mixer of the present invention comprises two types of vanes, that is, the stationary vane fixedly mounted within the casing and the movable vane connected with and oscillated by the source of oscillation in the casing. When the movable vane is oscillated by the source of oscillation, the distance between the stationary and movable vanes is oscillatorily varied so that the fluid existing near the movable and stationary vanes will be moved and oscillated to promote the agitation and mixture.

It is preferred that the stationary and movable vanes together defines a double-spiral shaped vane assembly or that the stationary and movable vanes forms a single spiral.

It is also preferred to form the movable vane into a spiral-like configuration while the stationary vane comprises a plurality of circular discs to define a substantially spiral-like passage together with the movable spiral-like vane. In such a case, the stationary vane includes opening means for permitting fluids to be mixed to pass therethrough and for allowing the insertion of the movable vane into the interior of the casing.

In accordance with the mixer of the present invention, the movable vane co-operates with the stationary vane to create a relative motion which applies a complicated turbulence to the fluids to accomplish a very effective mixture. Furthermore, the efficiency in manufacturing the mixer can be improved by dividing the casing and/or agitator into elements.

The above and other objects, features and advantages of the present invention will be apparent from reading the following detailed description of preferred embodiments with reference to the accompanying drawings.

DETAILED DESCRIPTION OF PREFERRED EMBODIMENTS

The present invention will now be described by way of example in connection with the drawings.

Figure 1:
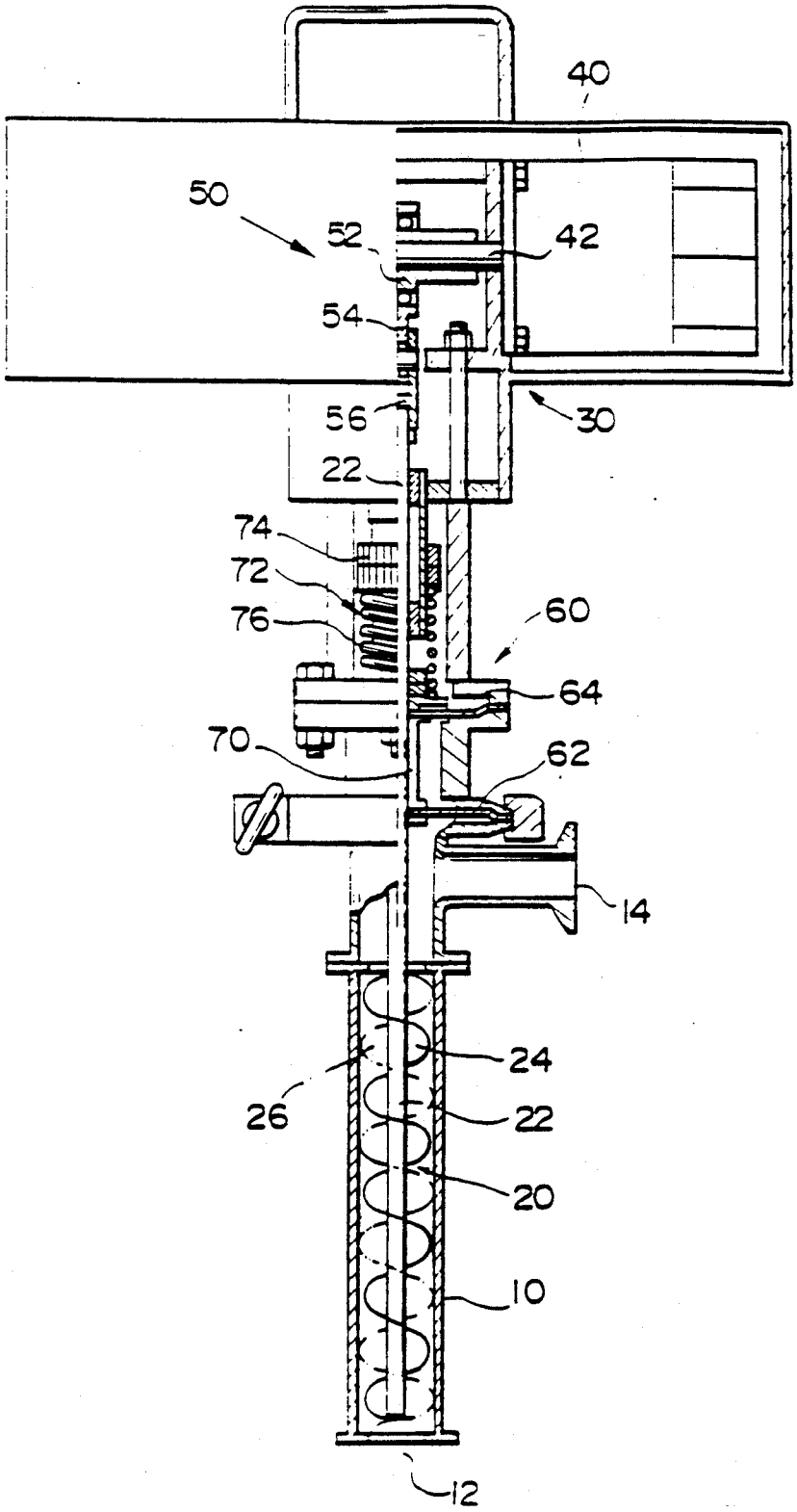
FIG. 1 is a fragmentary cross-sectional view of the entire structure of a mixer constructed in accordance with the present invention.

FIG. 1 shows the entire structure of a mixing system constructed in accordance with the present invention with the right half thereof being illustrated in cross-section.

Referring to FIG. 1, the mixing system comprises a cylinder-shaped casing 10 having a fluid inlet port 12 formed therein at the lower end. The upper portion of the casing 10 includes a fluid outlet port 14 formed therein. Fluid enters the interior of the casing 10 through the inlet port 12 and exits the casing 10 through the outlet port 14.

The casing 10 also comprises an agitator 20 disposed therewithin. In the present embodiment, the agitator 20 is characterized by that it comprises a movable vane 24 fixedly mounted around a shaft 22 and a stationary vane 26 fixedly attached to the casing 10. These vanes 24 and 26 are both of spiral configuration to provide a double-spiral arrangement.

Figure 2A:
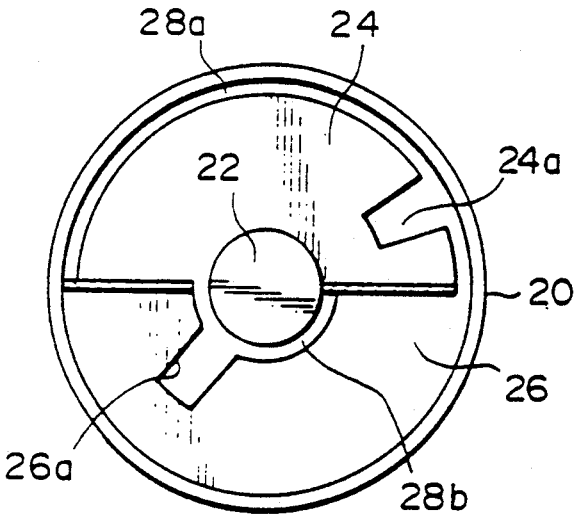
FIGS. 2A and 2B are top and side views illustrating an agitator 20 in one of preferred embodiments of the present invention.
Figure 2B:
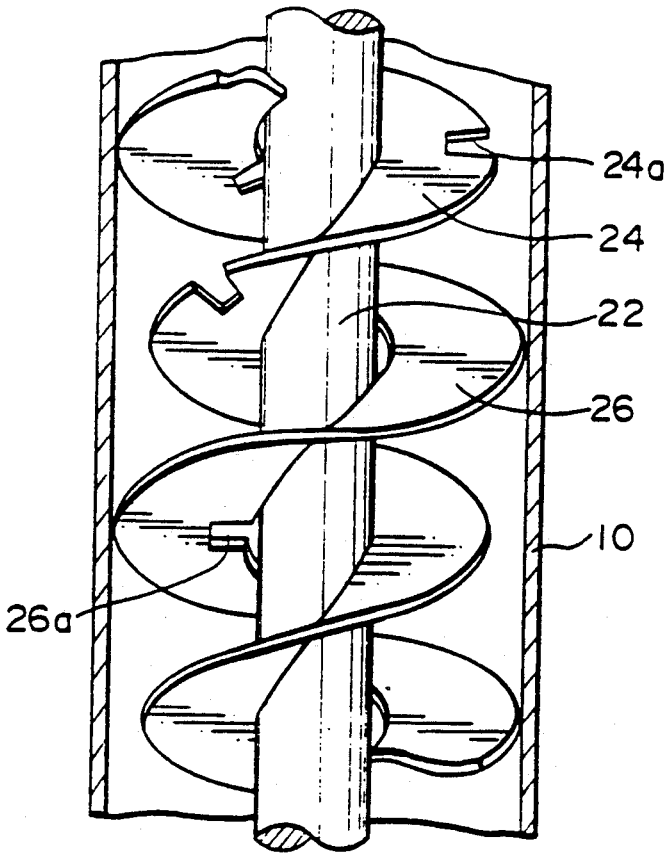

As be best seen from FIGS. 2A, and 2B, the movable spiral-like vane 24 is mounted around the shaft 22 by any suitable means such as welding. The stationary vane 26 is fixedly mounted on the casing 10 such as the vane 26 is arranged to surround the shaft 22.

The stationary vane 26 may be welded on the inner wall of the casing 10 although it is very difficult.

In order to overcome this difficulty, the present illustrated embodiment comprises a stationary spiral-like vane 26 having an axially extending through-bore, which has been previously formed as a separate part. Such a stationary vane 26 is axially inserted into the cylindrical bore of the casing 10 and then fixedly connected thereto at the opposite ends.

The movable vane 24 is screwed into the through-bore of the stationary vane 26 while rotating the shaft 22. As a result, a double-spiral stirrer or agitator 20 is defined by the movable and stationary vanes 24 and 26.

The movable vane 24 is arranged to form a gap 28*a* between the movable vane 24 and the inner wall of the casing 10 while the stationary vane 26 is located to form a gap 28*b* between the stationary vane 26 and the shaft 22. As the casing 10 is viewed in the axial direction, no short-circuiting path will be substantially created.

Openings 24*a* and 26*a* are formed in the movable and stationary vanes 24, 26 at suitably spaced locations. The fluid flows through these openings to promote the creation of turbulence. The openings 24*a* and 26*a* are located out of phase relative to each other without overlapping in the axial direction.

The shaft 22 extends upwardly from the casing 10 and is drivingly connected at the top end with a source of oscillation 30 which serves to oscillate the shaft 22. The source of oscillation 30 comprises a pair of motors 40 and a cam mechanism 50 operatively connected with the output shafts 42 of the respective motors 40. The cam mechanism 50 comprises a rotating portion 52 to which the output shaft 42 is eccentrically attached and a swinging portion 54 actuated by the eccentric rotation of the rotary portion 52. The oscillation of the swinging portion 54 is transmitted to the shaft 22 through a connection 56 to oscillate the shaft 22 up and down.

Two diaphragms 62 and 64 are provided at a connection 60 between the casing 10 and the source of oscillation 30 so that the fluid passing through the casing 10 will not enter the source 30. The diaphragms 62 and 64 are connected with each other by a pipe-like connecting member 70 such that they will move as a unit within a certain limited range. The upper diaphragm 64 is biased downwardly by a biasing member 72 under a predetermined pressure. Even if the pressure in the interior of the casing 10 increases to some degree, therefore, the increase of pressure will be resisted by the biasing pressure from the biasing member 72.

The biasing member 72 comprises a screw 74 and a spring 76. The screw 74 is rotated and moved to adjust the biasing force in the biasing member 72.

In such an arrangement, a mixture consisting of two or more fluids to be mixed is first poured into the interior of the casing 10 through the fluid inlet port 12 and flows through the casing 10 toward the fluid outlet port 14.

The flow of the mixture moves through the spiral path and also through the openings 24*a* and 26*a* in the movable and stationary vanes 24 and 26. As the fluid flows in such a manner, it is repeatedly split and jointed to create a turbulence.

At the same time, the source of oscillation 30 is actuated to oscillate the movable vane 20 up and down through the shaft 20 at any suitable frequency such as several tens Hz. Thus, the fluid will impinge against the surface of the movable vane 24.

When each of the turns of the movable vane 24 is oscillated between each adjacent turns of the stationary vane 26, the fluid will be forcedly shaken between the movable and stationary vanes 24 and 26 in the casing 10. This further promotes the mixing with very high effectiveness.

In such a manner, the mixer of the present invention provides three types of mixtures:

(A) Mixture of fluid by repeated separation and join;

(B) Mixture of fluid by impingement against the surface of the movable vane 24; and (C) Mixture of fluid due to the relative motion between the stationary and movable vanes 26, 24.

Figure 3A:
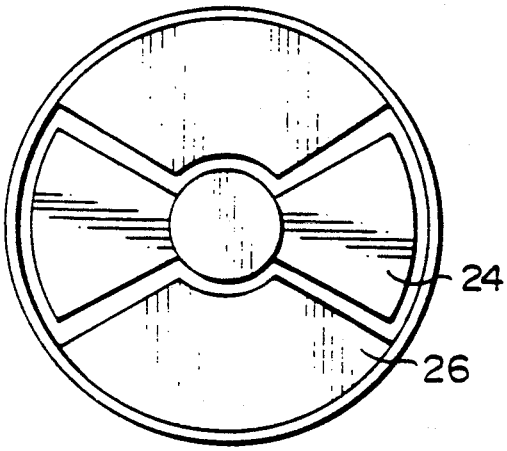
FIGS. 3A and 3B are top and side views illustrating an agitator 20 in another embodiment of the present invention.
Figure 3B:
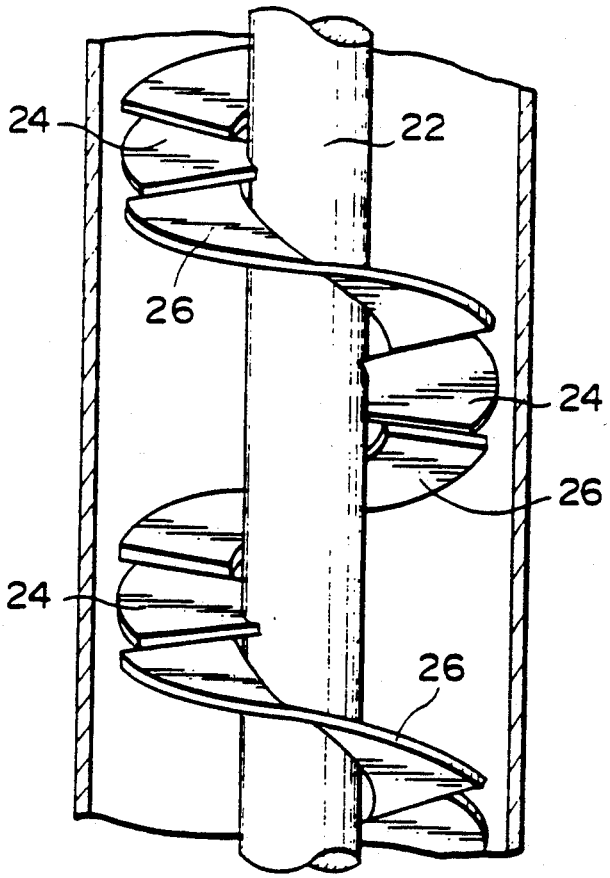

Referring next to FIGS. 3A and 3B, there is shown another embodiment of the present invention wherein movable and stationary vane sections 24 and 26 are alternately arranged to define a single-spiral agitator 20. In this illustrated embodiment, the agitator 20 is divided into four segments, that is, movable and stationary vane segments of 90 degree. However, the present invention will not be limited to such an arrangement and may be similarly applied to the increased number of segments.

When the shaft 22 is oscillated by the source of oscillation 30, the movable vane segments 24 mounted thereon are also oscillated relative to the stationary vane segments 26 to shake and stir the fluid, as in the previously described embodiment.

Figure 4A:
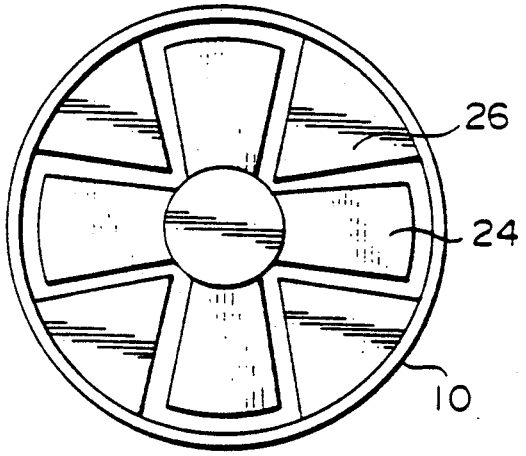
FIGS. 4A and 4B are top and side views illustrating an agitator 20 in still another embodiment of the present invention.
Figure 4B:
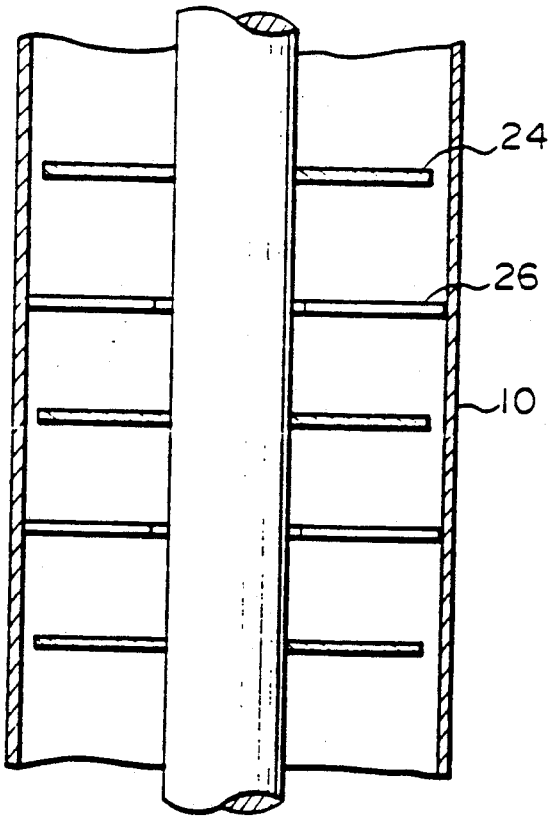

FIGS. 4A and 4B show still another embodiment of the present invention wherein an agitator 20 comprises a plurality of disc sections. Each of the disc section includes a movable vane 24 consisting of four radially extending vane portions on the shaft 22 and a stationary vane 26 including four stationary triangle-shaped vane portions 26 on the inner wall of the casing 10.

Similarly, the embodiment of FIG. 4 can perform the effective mixing operation by the rotating and oscillating motions of the movable vane 24 relative to the stationary vane 26.

Figure 5:
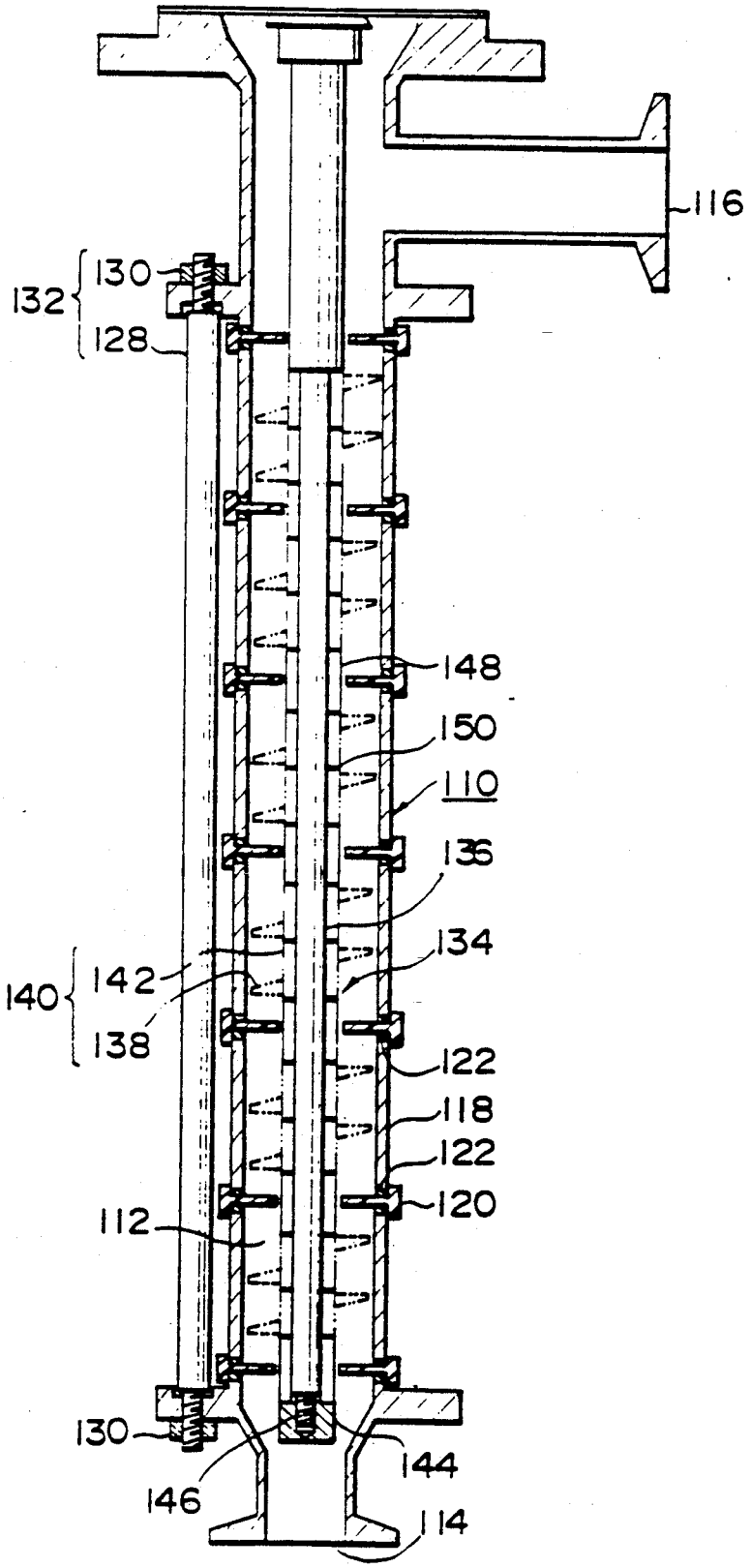
FIG. 5 is a cross-sectional view of the primary part of a further embodiment of the present invention.

FIG. 5 illustrates the primary part of a further embodiment of a mixer constructed in accordance with the present invention.

Referring to FIG. 5, a cylindrical casing 110 includes a flow passage 112 through which two or more different fluids will be moved and mixed together. The casing 110 also includes a fluid inlet port 114 formed therein at the lower end and a fluid outlet port 116 opened on the outer right-hand wall of the cylinder adjacent to the top end. Fluid is pumped into the interior of the casing 10 through the inlet port 114 and discharged out of the casing 10 through the outlet port 116.

The embodiment of FIG. 5 is characterized by that the casing 110 further comprises a plurality of cylindrical pipe sections 118 stacked one above another through partitioning plates 120 between each adjacent pipe sections 118.

Figure 6A:
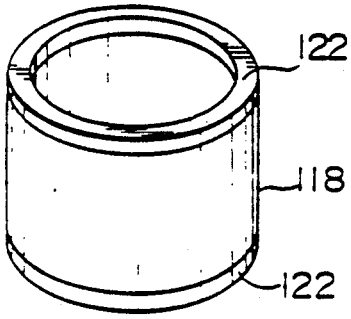
FIGS. 6A, 6B and 6C are perspective views illustrating various steps of assembling the casing in the embodiment shown in FIG. 5.
Figure 6B:
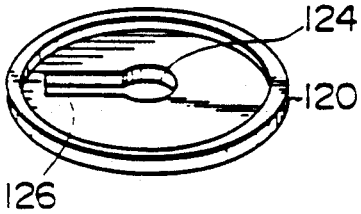
Figure 6C:
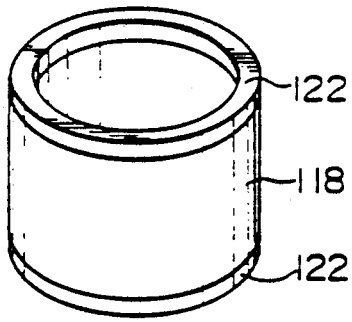

Referring now to FIGS. 6A–6C, there is shown various steps of assembling the casing 110 of FIG. 5. As shown, each of the cylindrical pipe sections 118 has opposite end faces on each of which a packing 122 is located to make the secure connection of the pipe section 118 with a partitioning plate 120 and also to provide an air-tight and fluid-tight seal between the end face of a pipe section and the corresponding face of a partitioning plate 120. The packing 122 may be made of a soft fluorine resin.

At the connection between two pipe sections 118, there is located a disc-like partitioning plate 120 having substantially the same diameter of the peripheral ridges as the external diameter of the pipe section 118 and being adapted to receive the end of a pipe section 118. The partitioning plates 120 may be made of a hard fluorine resin.

Figure 7:
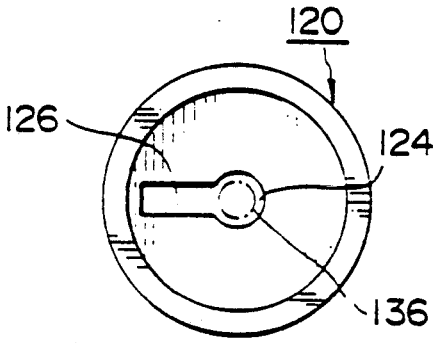
FIG. 7 is a plan view of a partition in the embodiment shown in FIGS. 5 and 6.

FIG. 7 is a plan view of a partitioning plate 120 which includes a central circle-shaped opening 124 formed therein. The central opening 124 receives a shaft on which the stirring elements of an agitator described hereinafter are mounted. The central opening 124 is connected with a slit-like aperture 126 formed in the partitioning plate 120 at one end to permit the fluid to pass therethrough. The aperture 126 also serves as an opening used to insert the spiral agitator into the interior of the casing 10.

Returning to FIG. 5, the casing 10, after formed by the pipe sections 118 and the partitioning plates 120, is clamped together at its top and bottom end by a fixture 132 which comprises a shaft 128 and top and bottom nuts 130. Although only one fixture 126 is illustrated in FIG. 5, it is preferred that the assembly of pipe and partitioning sections is clamped by three fixtures 132 around the casing 110.

Figure 8:
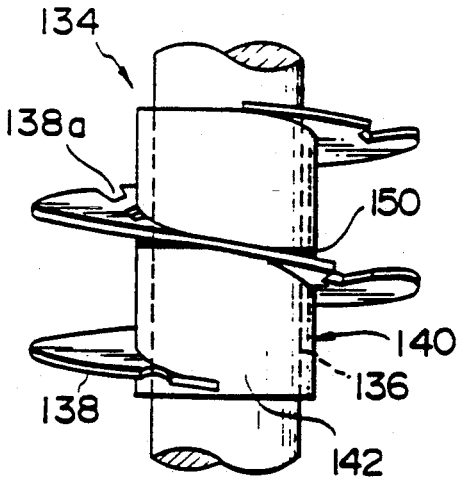
FIG. 8 is a front view of an agitator used in the embodiment shown in FIGS. 5 to 7.

The casing 110 further includes an agitator 134 inserted into and positioned in the casing 10. FIG. 8 shows a front view of such an agitator 134. The agitator 134 comprises a shaft portion 136 and a plurality of agitating elements 140 mounted around the shaft 136. Each of the agitating elements 140 includes a spiral-like vane 138. The vane 138 includes openings **138*a* formed therein and positioned out of phase in the axial direction of the vane 138. This prevents any short-circuiting flow from be created along the axial direction on the shaft 136** such that an stirring or agitating effect will be improved.

Preferably, an agitating element 140 may be formed as follows:

First of all, a disc having a diameter corresponding to the external diameter of the spiral-like vane 138 is provided. The disc is formed into a doughnut-shaped configuration by forming a central circle-shaped opening having a diameter corresponding to the internal diameter of a sleeve 142 which will be fitted over the shaft 136. Openings **138*a* are then formed in disc at the inner or outer edge thereof. The disc is then cut radially to the central opening and deformed axially with the cut edges being spaced away from each other in the axial direction. Thus, a vane 138 spirally extending through 360 degrees is formed and then fixedly mounted on the sleeve 142 by any suitable means such as welding. The agitating elements 140** may be formed of any suitable material such as plastic or ceramic.

Figure 9:
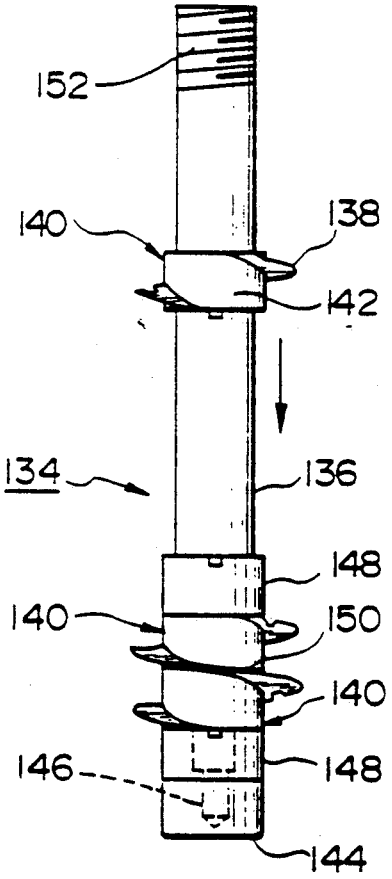
FIG. 9 illustrates the assembling of the agitator shown in FIG. 8.

FIG. 9 illustrates the process of assembling the agitator of FIG. 8. As seen from this figure, the shaft portion 136 includes a flange 144 fixedly attached thereto by a screw 146 at the lower end of the shaft. Agitating elements 140 and spacers 148 are alternately fitted over the shaft portion 136 and stacked one above another along the shaft. It is to be noted that a packing 150 is sealingly located between each adjacent agitating elements 140. The stacked agitating elements 140 and spacers 148 are then clamped between the flange 144 and a blind nut which is threadedly screwed onto the shaft 136 at the top threaded end portion 152 thereof. In such a manner, an agitator 134 having agitating vanes 138 spaced away from one another with a predetermined distance.

Figure 10:
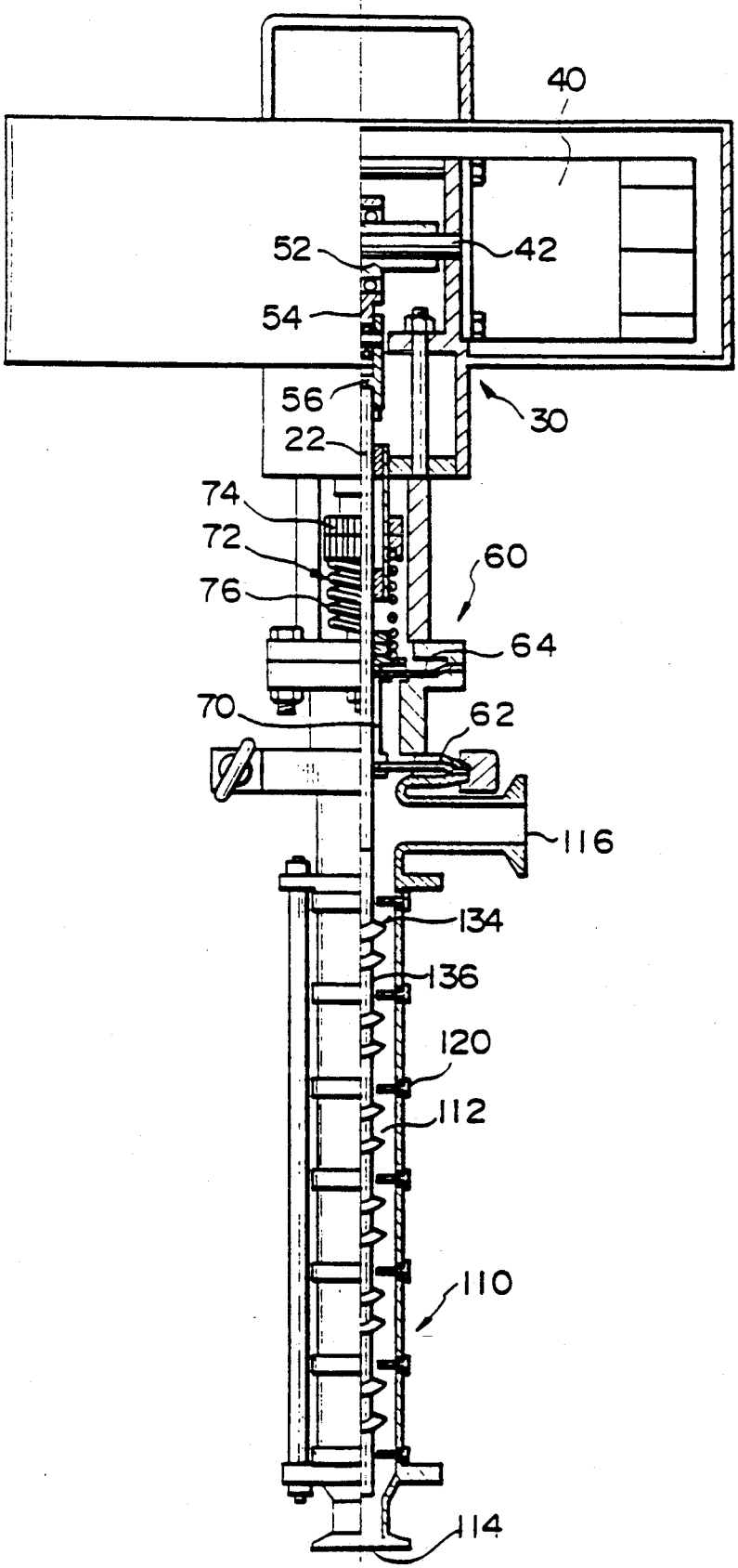
FIG. 10 is a cross-sectional view of the entire arrangement of a mixing reactor constructed according to the embodiment shown in FIGS. 5 to 9.

FIG. 10 is a cross-sectional view of the entire arrangement of a mixing and reacting apparatus according to the present embodiment of the invention. The apparatus is the same as that shown in FIG. 1, except the casing 110 and agitator 134.

In this arrangement, two or more different fluids to be mixed together are similarly fed into the interior of the casing 110 through the inlet port 114 and move to the outlet port 116 through the flow passage 112 within the casing 110. The casing 110 includes a plurality of partitioning plates 120 fixedly arranged therein and spaced longitudinally away from one another. Each of the partitioning plates 120 includes a central opening formed therein. As the fluids pass through the central openings of the partitioning plates 120; they are subjected to turbulence. In addition, the fluids are oscillated and shaken by the agitator 134 which is being oscillated by the source of oscillation 54. Since the partitioning plates 120 are stationary in the casing 110, the fluids can be stirred and mixed very effectively by the relative motion between the agitator 134 and the partitioning plates 120.

In accordance with the present embodiment, the casing 110 comprises a plurality of stacked pipes 118 with a partitioning plate 120 located between each adjacent pipes 118. Thus, the casing 110 can be assembled or disassembled easily. Further, the casing 110 can be easily and simply subjected to maintenance and changed into a desired arrangement only by exchanging the pipes and partitioning plates for pipes and plates having different sizes.

The agitator 134 includes spiral ribbon-like vanes 138 as shown in FIG. 8 while each of the partitioning plates 120 includes a radially extending slit-like opening 126 as shown in FIGS. 6 and 7. Therefore, the spiral vanes 138 in the agitator 134 may be inserted into the interior of the casing 110 through the slit-like openings 126 of the partitioning plates 120 while rotating the agitator 134. In such a manner, the agitator 134 can be set properly in the casing 110, as shown in FIG. 10.

Furthermore, the agitator 134 may be constructed by a shaft portion 136 and a plurality of stacked agitating elements 140 about the shaft portion 136. On assembling the casing 110, an agitator having a desired configuration (e.g. a flat plate having an opening formed therein) may be incorporated into a space defined by each adjacent partitioning plates.

Although the aforementioned embodiments have been described as to the source of oscillation in the form of a motor-cam mechanism, the source of oscillation may be replaced by any other suitable means. For example, the source of oscillation may be preferably in the form of electromagnetic drive or ultrasonic drive, depending on the necessary frequency or amplitude.

In accordance with the principle of the present invention, a plurality of oscillation sources may be combined so as to provide both larger and smaller oscillations to the movable vane simultaneously.

What is claimed is:

1. A mixing apparatus for agitating and mixing fluids together, said apparatus comprising:

a casing through the interior of which fluids pass;

a stationary vane fixedly mounted in said casing and extending inwardly from the inner wall of said casing;

an agitator movably disposed within said casing, said agitator including: a shaft and a fixed vane mounted thereon around the circumference of said shaft, said agitator being movable only by oscillation in an axial direction of said casing by an amount less than an axial gap between adjacent stationary vanes; and a source of oscillation connected with said shaft to oscillate said agitator, whereby the fixed vane can be oscillated while permitting the fluids to pass through said casing, thereby creating a relative motion between said fixed and stationary vanes so as to agitate and mix the fluids together, wherein each of said stationary and fixed vanes includes an opening formed therein, each said opening being located out of phase relative to each other without overlapping in the axial direction, each said opening of said stationary vane being located on an inner edge of said stationary vane and each said opening of said fixed vane being located on an outer edge of said fixed vane, said stationary and fixed vanes being in the form of spiral-like vanes and together they define a double-spiral configuration.

* * * * *